US008615338B2

(12) United States Patent
Creissels

(10) Patent No.: US 8,615,338 B2
(45) Date of Patent: Dec. 24, 2013

(54) AERIAL TRAMWAY WITH MONITORING OF THE NUMBER OF PASSENGERS ALLOWABLE IN THE TRAM CAR

(75) Inventor: Denis Creissels, Meylan (FR)

(73) Assignee: Creissels Technologies, Meylan (FR)

( * ) Notice: Subject to any disclaimer, the term of this patent is extended or adjusted under 35 U.S.C. 154(b) by 0 days.

(21) Appl. No.: 13/513,808

(22) PCT Filed: Dec. 2, 2010

(86) PCT No.: PCT/FR2010/000803
§ 371 (c)(1),
(2), (4) Date: Jun. 4, 2012

(87) PCT Pub. No.: WO2011/067486
PCT Pub. Date: Jun. 9, 2011

(65) Prior Publication Data

US 2012/0245769 A1 Sep. 27, 2012

(30) Foreign Application Priority Data

Dec. 3, 2009 (FR) ..... 09 05847

(51) Int. Cl.
*G05D 1/00* (2006.01)

(52) U.S. Cl.
USPC ..... 701/19

(58) Field of Classification Search
USPC ..... 701/1, 19; 340/541; 187/391
See application file for complete search history.

(56) References Cited

U.S. PATENT DOCUMENTS

| | | | | | |
|---|---|---|---|---|---|
| 3,788,232 | A * | 1/1974 | Schneider et al. | 104/88.03 |
| 4,092,718 | A * | 5/1978 | Wendt | 701/117 |
| 5,176,082 | A * | 1/1993 | Chun et al. | 104/28 |
| 5,485,347 | A * | 1/1996 | Miura | 702/128 |
| 5,920,057 | A * | 7/1999 | Sonderegger et al. | 235/384 |
| 6,741,175 | B1 * | 5/2004 | Rauch | 340/541 |
| 6,919,804 | B1 * | 7/2005 | Cook et al. | 340/541 |
| 7,541,926 | B2 * | 6/2009 | Dugan et al. | 340/572.1 |
| 7,712,586 | B2 * | 5/2010 | Legez | 187/391 |
| 8,254,631 | B2 * | 8/2012 | Bongard | 382/103 |
| 2006/0009905 | A1 * | 1/2006 | Soderberg et al. | 701/200 |
| 2008/0195257 | A1 * | 8/2008 | Rauch | 701/1 |
| 2009/0120727 | A1 * | 5/2009 | Hamaji et al. | 187/391 |

FOREIGN PATENT DOCUMENTS

| | | | | |
|---|---|---|---|---|
| EP | 1 980 466 | A1 | 10/2008 | |
| FR | 2 752 803 | A1 | 3/1998 | |
| JP | 2000030182 | A * | 1/2000 | G08G 1/005 |

OTHER PUBLICATIONS

International Search Report issued in International Application No. PCT/FR2010/000803 dated Feb. 2, 2012.

* cited by examiner

*Primary Examiner* — Mary Cheung
*Assistant Examiner* — Anne Mazzara
(74) *Attorney, Agent, or Firm* — Oliff & Berridge, PLC

(57) ABSTRACT

The embarkation of passengers onto a vehicle of a transport installation with an aerial cable, comprising selectively served intermediate stations, is controlled by a programming device calculating the number of passengers allowed to go into a double-entrance security door and to embark onto a vehicle stopping at the station, according to the number of passengers in the vehicle and to the number of passengers disembarking from the vehicle at this station as they have compulsorily indicated when embarking.

7 Claims, 2 Drawing Sheets

AERIAL TRAMWAY WITH MONITORING OF THE NUMBER OF PASSENGERS ALLOWABLE IN THE TRAM CAR

TECHNICAL FIELD OF THE INVENTION

The invention relates to a transport installation with an aerial cable whose vehicles are coupled with the line cable and selectively serve intermediate stations.

STATE OF THE ART

Such installations are known which, at intermediate stations, passengers can disembark from and embark onto cable cars according to the vacant seats and/or the seats to become vacant, which usually requires the presence of one or more employees for supervising and controlling these operations of disembarkation and embarkation and for checking that the maximum number of passengers allowed in the cable cars is not exceeded.

Such installations with intermediate stations are relatively rare in the case of cableways for tourists, whereas there is today an important development of the use of this technology in urban (or peri-urban) transportation where there can be a great number of intermediate stations in which it is not acceptable anymore that disembarkation and embarkation of passengers are still regulated and controlled by employees regarding safety, availability and installation flow and from the economic point of view.

OBJECT OF THE INVENTION

The object of the invention consists providing a transport installation with aerial cables including intermediate stations, which makes it possible to automatically control the number of passengers allowed in the cable car.

The installation according to the invention is characterized in that it comprises:

- at the entry of each station, a device for compulsorily recording the destination of each passenger,
- a programming device centralizing information about the displacement and the destination of the vehicles and information about the embarkation and disembarkation of passengers, said programming device calculating, from the number of passengers who have embarked and disembarked at the preceding stations, the number of passengers in the vehicle stopping at the station, and subtracting therefrom the recorded number of passengers disembarking at the station in order to determine the number of passengers allowed to embark.

The passengers take place for embarking into a vehicle serving their destination and the number of passengers allowed to embark is calculated according to the number of passengers in the vehicle stopping at the station and to the number of passengers disembarking from the vehicle.

Only the number of passengers, who can take seat in the vehicle, without exceeding the lawful capacity of the vehicle, is allowed on the embarkation platform.

According to one development of the invention, each station comprises a double-entrance security door for reaching the embarkation platform, allowing the entry of the passengers whose destination corresponds to the destinations served by the next vehicle stopping at the station, subject to availability. The device for compulsorily recording the destination of passengers is arranged at the double-entrance security door.

Other characteristics can be used separately or in combination in various embodiments:

- the station advantageously comprises a display device for the destinations served by the next vehicle stopping at the station.
- the station comprises, at the double-entrance security door, a panel supporting both the recording device in the form of a keyboard, the display device for the served destinations, an indicator for the remaining number of passengers allowed in the double-entrance security door and a lamp indicator which is on when the allowed number is reached.
- a controller of the entry into the double-entrance security door counts the passengers and allows the access to the double-entrance security door as long as the number of passengers allowed to embark onto the vehicle is not reached.

The passengers must also indicate their destinations,

- the programming device actuates a device for blocking the entry of the double-entrance security door when the number of passengers allowed to embark onto the vehicle is reached.
- the station comprises at the entrance of the station a gate which indicates, inter alia, stations served by the next vehicle stopping at the station and the remaining time before this vehicle arrives.
- the programming device can cancel the stop of a vehicle at a station when there is no passenger to be embarked or disembarked there.

DESCRIPTION OF THE DRAWINGS

The invention will more clearly arise from the following description of a particular embodiment represented in the annexed drawings in which.

DETAILED DESCRIPTION OF THE INVENTION

Figure 1:
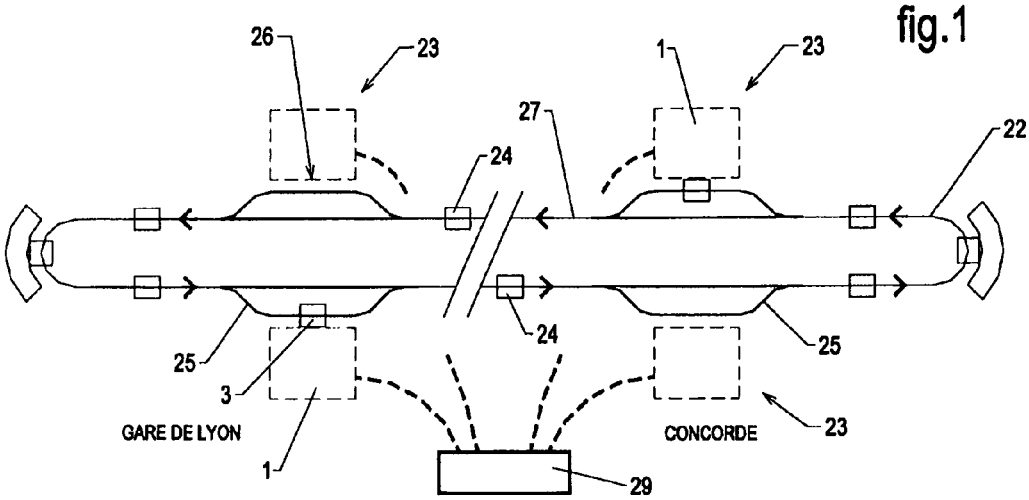
FIG. 1 is a schematic view of an installation according to the invention.

In FIG. 1, a loop-shaped installation 22 with an aerial cable comprises vehicles 24 which serve several intermediate stations 23. Each station comprises a secondary track 25, leading to a platform 26 for embarking and disembarking passengers, a direct track 27 for the passage of vehicles not stopping at the station. Of course, the invention is applicable to an installation with only one track. The station 23 includes an entry 1, described in more detail by referring to FIG. 2, and a programming device 29 controlling the whole operation of the installation, in particular the number of passengers in vehicles.

Figure 2:
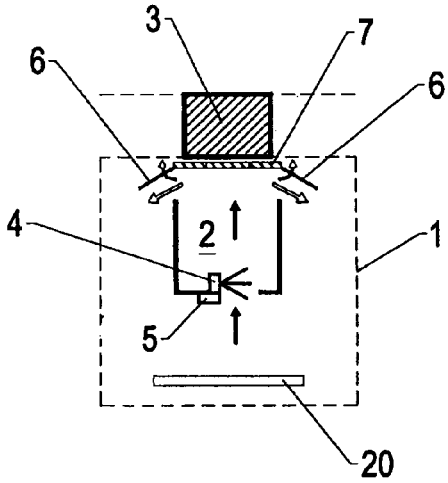
FIG. 2 is a view, on a magnified scale, of the access controller in FIG. 1.
Figure 4:
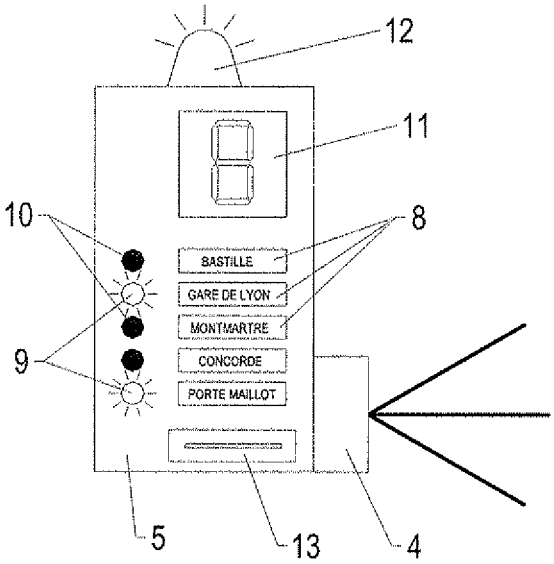
FIG. 4 represents the panel at the entrance of the double-entrance security door.

In FIG. 2 the platform 26 at which the one 3 of the vehicles 24 has stopped belongs to a double-entrance security door 2 the passengers go into for embarking into the vehicle 3. An access controller 4, represented in detail in FIG. 4, is arranged at the entry of the double-entrance security door 2. The controller 4, which is represented by a revolving gate but which can be of a different type, comprises a table 5 on which a passenger must indicate his/her destination station, and validate his/her transport document. As in the majority of the cases, embarkation and disembarkation are carried on the same platform, the double-entrance security door 2 is provided with reverse-lock exit gates 6. Sensitive entrances 7 or a beam detector, arranged at the exit of the double-entrance security door, check the passengers are embarking properly.

In FIG. 4, the table 5 includes a keyboard with pushbuttons 9, 10 corresponding to the station display 8. If the button 9 is on, it indicates that this station is served by the vehicle 3 stopping at the station while, if the button 10 is off, it corresponds to a not-served station. The passenger going into the double-entrance security door 2 actuates the button 9 corresponding to his/her destination. Moreover, the table 5 comprises a validation device 13 for the transport document, a display 11 for the remaining number of passengers to be allowed and a lamp indicator 12 whose color can vary (from fixed green to winking red, for example), according to the time remaining for selection or the number of places available.

Figure 3:
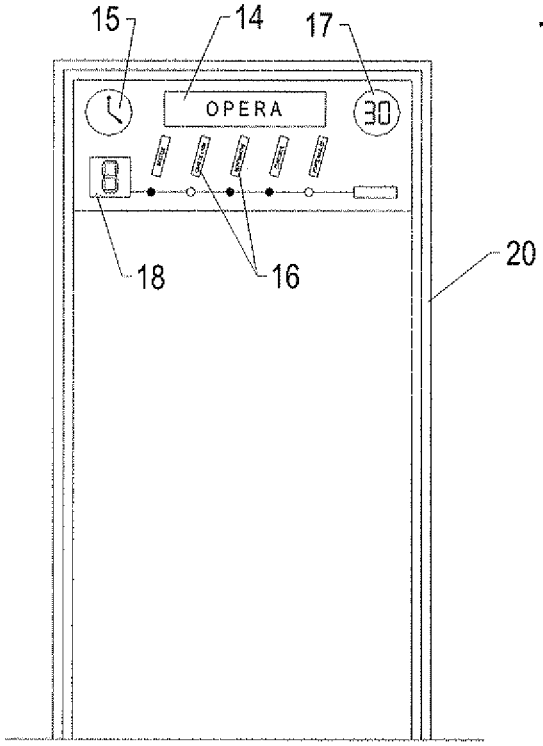
FIG. 3 represents a gate at the entrance of the station.

In FIG. 3 it is represented a gate 20 arranged at the entry of the station and giving a passenger a maximum of information such as the name 14 of the station, the time 15, the stations 16 served by the next vehicle, the calculation of the time 17 of arrival of the vehicle and the remaining number 18 of passengers to be allowed.

The operation of the installation arises from the preceding presentation. A passenger checks on the gate 20 if the next vehicle serves his/her destination and if there are places available. If so, he/she goes to the access controller 4, actuates the button 9 corresponding to his/her destination, validates his/her transport document and goes into the double-entrance security door 2. On arrival of the vehicle 3 the gates 7 open and he/she can embark. The programming device 29 has received the information about the entry of the passenger into the double-entrance security door 2 and his/her destination and, as it has memorized the information received at the time of the passage of the vehicle at the preceding stations and takes into account the passengers who have disembarked at these stations, it knows the number and the destinations of the passengers in the vehicle. It also knows the next destination of the vehicle and by subtracting from the number of passengers in the vehicle the number of passengers disembarking at the station it deduces the number of places available for an embarkation at the next station to which this information is transmitted.

The control of the specifications according to the invention allows a complete automation of the installation, in particular through the programming device 29. If, before a vehicle arrives at a station, no passenger has chosen this station as a destination and no passenger has been recorded by the access controller at said station, the programming device can modify the programming of the vehicle so that this vehicle runs through the station without stopping.

The station of destination is specified by a passenger through a keyboard on which the stations served by the on-coming vehicle are very clearly shown, and these destinations are transmitted to the programming device with the number of passengers going into the double-entrance security door.

The invention claimed is:

1. Transport installation with an aerial cable, comprising vehicles coupled with the line cable and serving intermediate stations, said installation comprising:

at the entry of each station, a recording device for compulsorily recording the destination of a passenger, a programming device centralizing data about the displacement and the destination of the vehicles and data about the embarkation and disembarkation of passengers, said programming device calculating, from the number of passengers who have embarked and disembarked at the preceding stations, the number of passengers in the vehicle stopping at the station and subtracting therefrom the recorded number of passengers disembarking at the station in order to determine the number of passengers allowed to embark, and a double-entrance security door for reaching the embarkation platform the passengers goes onto whose destination corresponds to the destinations served by the next vehicle stopping at the station, subject to availability.

2. Installation according to claim 1, wherein the recording device for compulsorily obligatory recording the destination is arranged at the entry of the double-entrance security door.

3. Installation according to claim 1, wherein the station comprises a display device for the destinations served by the next vehicle stopping at the station.

4. Installation according to claim 1, wherein the station comprises, at the entry of the double-entrance security door, a panel supporting (i) the recording device, (ii) a display device for the destinations served by the next vehicle stopping at the station, (iii) an indicator of the remaining number of passengers to be allowed in the double-entrance security door and (iv) a lamp indicator becoming on when the allowed number is reached, wherein the recording device is a keyboard.

5. Installation according to claim 1, wherein the programming device actuates a device for blocking the entry into the double-entrance security door when the number of passengers allowed to embark onto the vehicle is reached.

6. Installation according to claim 1, wherein the station comprises at the entry of the station a gate which indicates, inter alia, the stations served by the next vehicle stopping at the station and the time remaining before this vehicle arrives.

7. Installation according to claim 1, wherein the programming device can cancel a stop of a vehicle at a station when there is no passenger to be embarked or disembarked there.

* * * * *